US005315721A

United States Patent [19]

Okun

[11] Patent Number: 5,315,721

[45] Date of Patent: May 31, 1994

[54] COLLAPSIBLE SHOWER STALL

[76] Inventor: Milton R. Okun, 168 Neponset St. Apt. 6, Canton, Mass. 02021

[21] Appl. No.: 1,445

[22] Filed: Jan. 7, 1993

[51] Int. Cl.[5] ..... A47K 3/23

[52] U.S. Cl. ..... 4/599; 4/607; 4/610

[58] Field of Search ..... 4/599, 600, 602, 603, 4/607, 608, 610, 585, 586; 211/105.1; 160/330

[56] References Cited

U.S. PATENT DOCUMENTS

| | | | |
|---|---|---|---|
| 1,049,714 | 1/1913 | Herscovitz | 4/602 |
| 2,380,665 | 7/1945 | Morris | 4/608 |
| 2,561,265 | 7/1951 | Burns | 4/599 |
| 2,654,893 | 10/1953 | DeScranage | 4/610 |
| 3,191,190 | 6/1965 | Lowry | 4/585 |
| 3,590,398 | 7/1971 | Jetter | 4/599 |
| 3,646,590 | 2/1972 | Bolt | 4/600 |
| 3,657,746 | 4/1972 | Downey | 4/599 |
| 4,413,363 | 11/1983 | Troiano | 4/599 |
| 4,594,742 | 6/1986 | Ziegler et al. | 4/607 |

*Primary Examiner*—Henry J. Recla
*Assistant Examiner*—Charles R. Eloshway
*Attorney, Agent, or Firm*—Wolf, Greenfield & Sacks

[57] ABSTRACT

A collapsible shower apparatus mounted in a room having a water drain in a floor, the apparatus comprising a base unit collapsible into a space-compact position and expandable into a first water-containment enclosure surrounding the drain in the floor and extending from the floor upwardly to a predetermined height above the floor, and an upper unit mounted above the base unit, the upper unit being collapsible into a space-compact position and expandable into a second water-containment enclosure extending directly above the first enclosure formed by the base unit when expanded, and fitting into the base unit.

22 Claims, 15 Drawing Sheets

COLLAPSIBLE SHOWER STALL

BACKGROUND OF THE INVENTION

The present invention relates to an apparatus for creating a shower stall and more particularly to an apparatus which can be mounted in a room and reversibly collapsed and expanded into space-compact and shower-ready use positions.

SUMMARY OF THE INVENTION

In modern building construction and renovation, space within a building is often divided into rooms of varying size, with a premium often placed on maximizing the useability of the floor space. As a result, small rooms are often created for a particular utilitarian or convenience purpose such as half-bathrooms. In a half-bathroom, a sink and a toilet may be provided without also including a bathtub and accompanying shower head or shower stall because the size of the room will not accommodate a conventionally-sized bathtub or shower stall.

In general, space in new buildings and renovated buildings is at a premium, and there is a need to utilize the space in the most efficient way.

Therefore in accordance with the invention there is provided a collapsible apparatus for creating a shower enclosure that allows alternate use of space when the apparatus is in a collapsed state, the apparatus comprising a first flexible, water-impervious enclosure surrounding a drain disposed in the floor, and being flexibly extendible to form a dimensionally-stable, water-impermeable, shower-ready base in which a human can stand and move about, and a second flexible, water-impervious enclosure, mounted directly above the first enclosure, the second enclosure being collapsible into a compact position and being expandable into a second enclosed water containment position, the second enclosure comprising a flexible, water-impermeable sheet material hung on a ringlike support mechanism, the support mechanism being mounted above the first enclosure, the flexible sheet material having a sufficient length such that, in its expanded position, a bottom end of the second enclosure fits into and extends below the top end of the first enclosure when extended; and a water-dispensing outlet for projecting a spray of water downwardly through both enclosures when expanded.

BRIEF DESCRIPTION OF THE DRAWINGS

As is evident from the Figures, the same reference numerals are used to refer to analogous components among the various embodiments depicted.

DETAILED DESCRIPTION OF EXEMPLARY EMBODIMENTS

Following is a description of exemplary embodiments of the invention with detailed reference to the Figures for purposes of explanation. Analogous components of various components are referenced with the same numerals.

Figure 1:
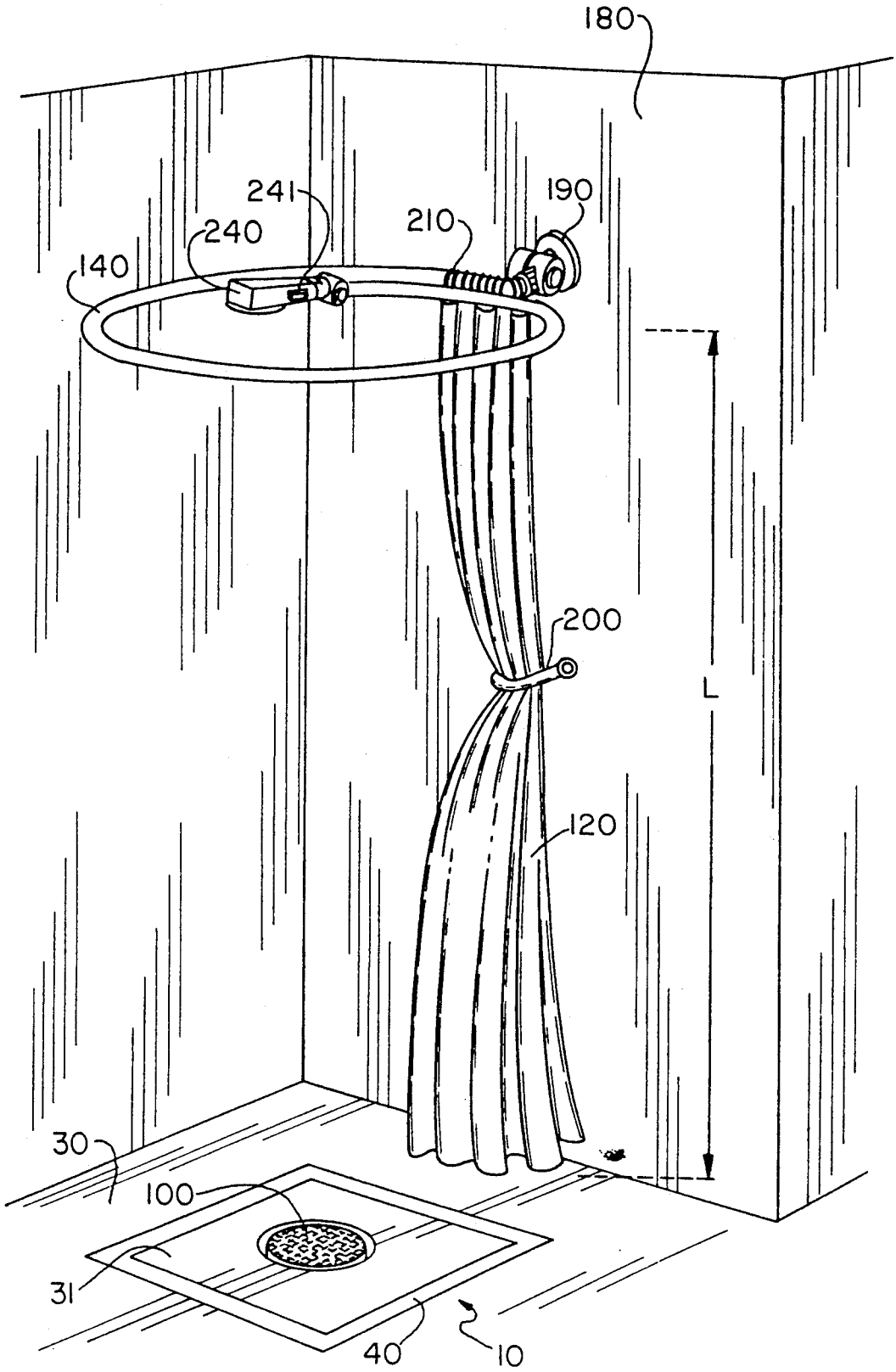
FIG. 1 is a perspective view of one embodiment of an apparatus according to the invention shown in a collapsed state.

FIG. 1 shows an apparatus according to the invention in a collapsed space-compact state. The base unit 10 is collapsed into a recess which is disposed within the floor 30 surrounding a water drain outlet 100.

Figure 2:
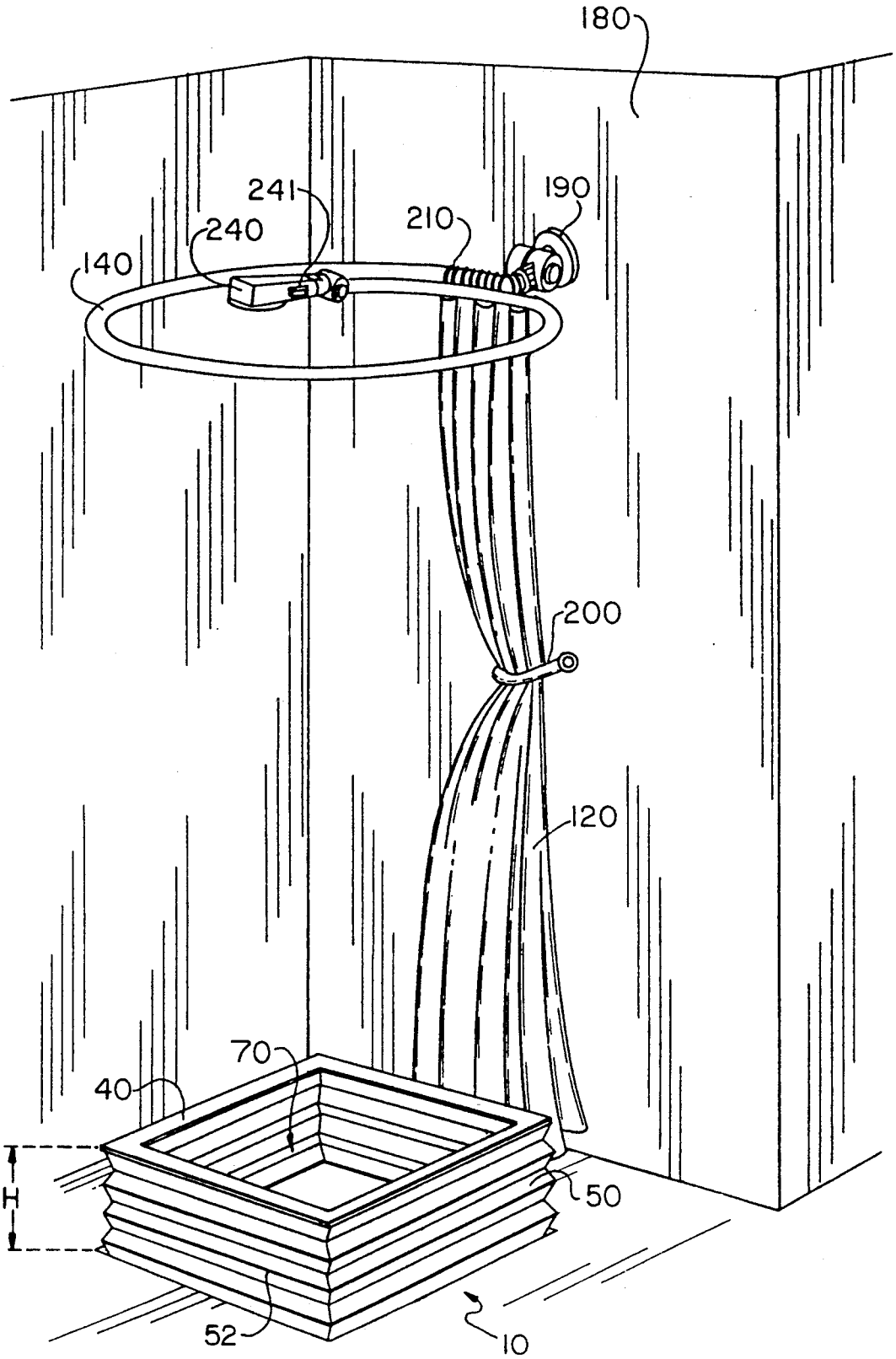
FIG. 2 is a perspective view of the apparatus of FIG. 1 showing a collapsible base unit mounted in a floor of a room in an extended shower-ready position.
Figure 3:
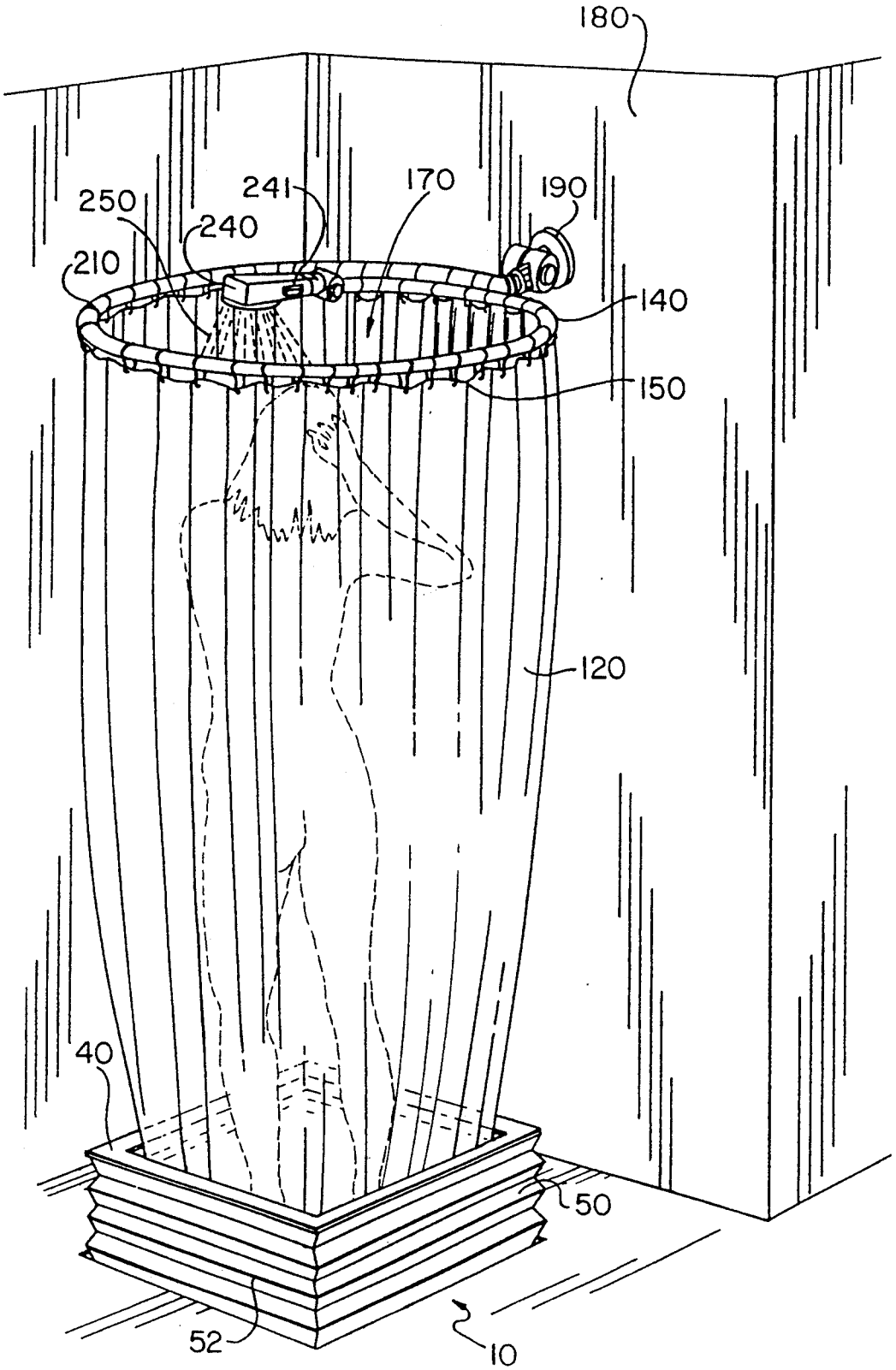
FIG. 3 is a perspective view of the apparatus of FIG. 1 showing the base and upper units expanded and a human standing within the expanded enclosures taking a shower.
Figure 6:
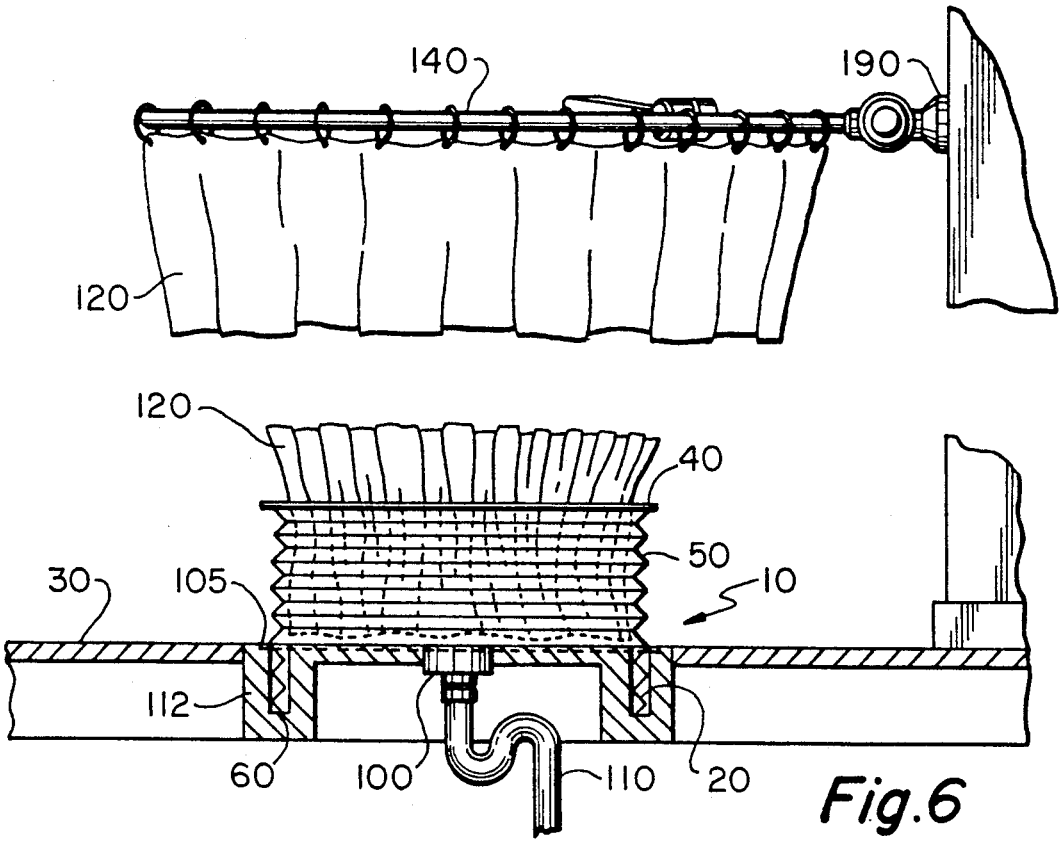

The base unit 10 typically comprises a flexible water-impervious wall material 50, FIGS. 2, 3, 6 such as a foldable (e.g. into a bellows) and reversibly expandable sheet of water-impervious plastic, cloth, cloth coated with water-impervious material such as silicone, combinations of sheet form plastic, cloth, coated cloth and the like.

The base unit 10 is expandable into a shower-ready position as shown in FIG. 2 whereby it encloses a space 70 in which water is contained. As shown in FIG. 1 the base unit 10 is initially collapsed into the floor 30. After the base unit 10 is expanded into the position shown in FIG. 2, the upper unit comprising a support rod 140 and a flexible water-impervious curtain 120 which is slidably hung on the rod 140 is expanded into a water-containment enclosure position as shown in FIG. 3. The curtain 120 is initially strapped in a compact position against the wall 180 of the room by a strap 200 as shown in FIGS. 1, 2. The curtain 120 is slidably hung at its top end on the support rod 140 by conventional means such as ringlike curtain hangers 210 which encircle the rod 140 and are attached to the top end of the curtain 120. The curtain is expandable into the enclosure position shown in FIGS. 3, 4 by manually sliding the hangers 210 around the length of the rod 140.

Figure 4:
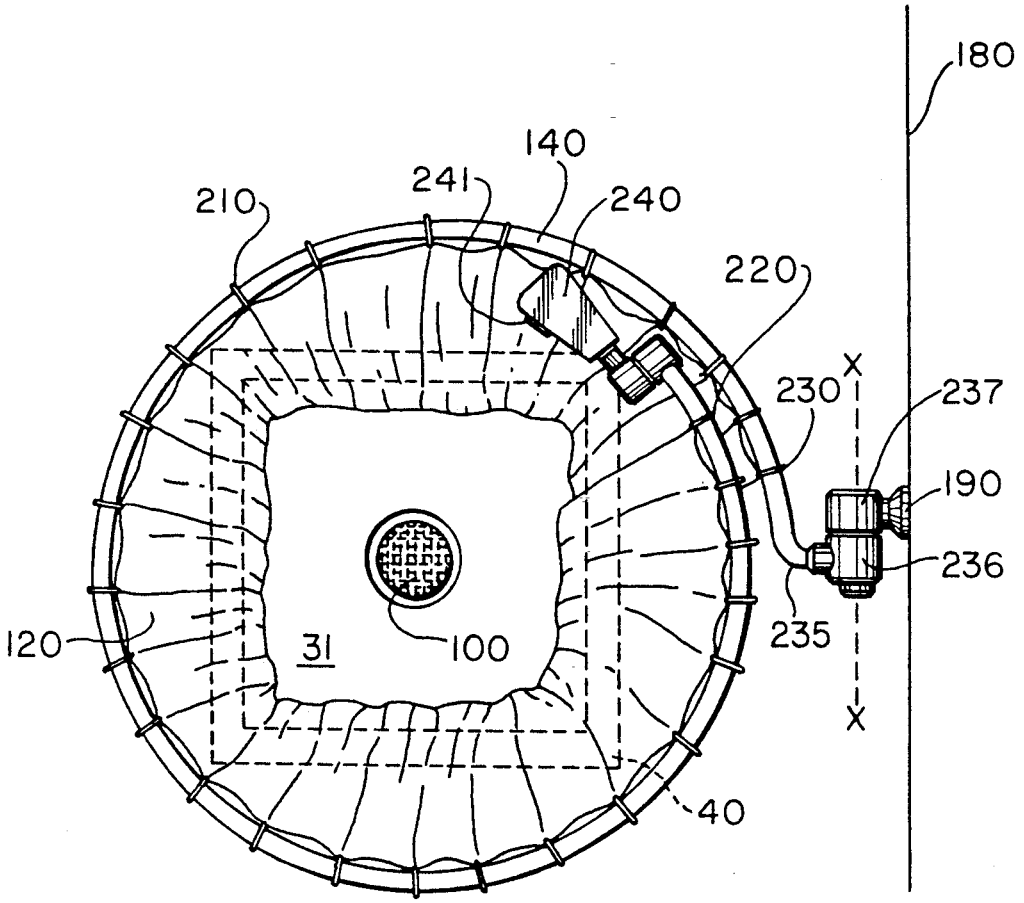
FIG. 4 is a top plan view of the expanded apparatus of FIG. 1.

The curtain 120 may comprise the same sort of sheet material as described above with reference to sheet material 50. The curtain 120 has a top to bottom length L, FIG. 1, which is selected such that the bottom end of the curtain 120 will extend below the height H, to which the top end 40 of the base unit 10 extends above the floor when the base unit 10 is expanded, FIG. 2. As shown in FIGS. 3, 4 the bottom end of the curtain 120 is inserted inside the perimeter of the open top end 40 of the expanded base unit 10. The expanded curtain 120 and base unit 10 thus form a single water-containment enclosure as shown in FIG. 3 whereby when a water spray 250 is dispensed from above and aimed toward the enclosed space 170 formed by the expanded curtain 120 (and expanded base unit 10), all of the water spray 250 falls by gravity from space 170 into space 70 and eventually onto the floor space 31, FIG. 1, surrounding the water drain 100 in the floor 30. In a preferred embodiment the support rod 140, FIGS. 1–4, is a spiral-shaped hollow tube which is fixedly mounted at a predetermined height above the floor by a conventional mounting bracket 190, FIGS. 1–3, the tube 140, FIGS. 1–4, is sealably connected behind the wall 180, FIGS. 1–3, by conventional means to a source of water input (such as water-feed pipes behind the wall, not shown) which feeds a flow of water through the tube 140, FIGS. 1–4, to a conventional water-dispensing outlet 240, FIGS. 1–4, connected to the inner terminal end of the spiral support tube 140, FIGS. 1–4. The water-dispensing outlet 240, FIGS. 1–4, includes a conventional control valve mechanism 241, FIGS. 1–3 (and all other figures where the water-dispensing outlet is shown) for opening and closing the flow of water 250, FIG. 3, to be dispensed and for temperature regulation of the water. As shown, the mounting of the outlet 240, FIGS. 1–4, on the spiral tube 140, FIGS. 1–4, provides a convenient space-compact mechanism for dispensing a shower spray 250, FIG. 3, and ensures that the spray 250, FIG. 3, is directed into the enclosed spaces 170, 70, FIGS. 2, 3 formed by the expanded upper and lower unit enclosures. It is to be noted that the enclosed space formed by the upper unit enclosure is larger in cross-section than the enclosed space formed by the lower unit enclosure. This makes use of abundant air space, even in small rooms, allowing free movement of a person's arms, and the usually more limited floor space in small rooms, sufficient to accommodate lesser required movements of the lower legs.

Figure 11:
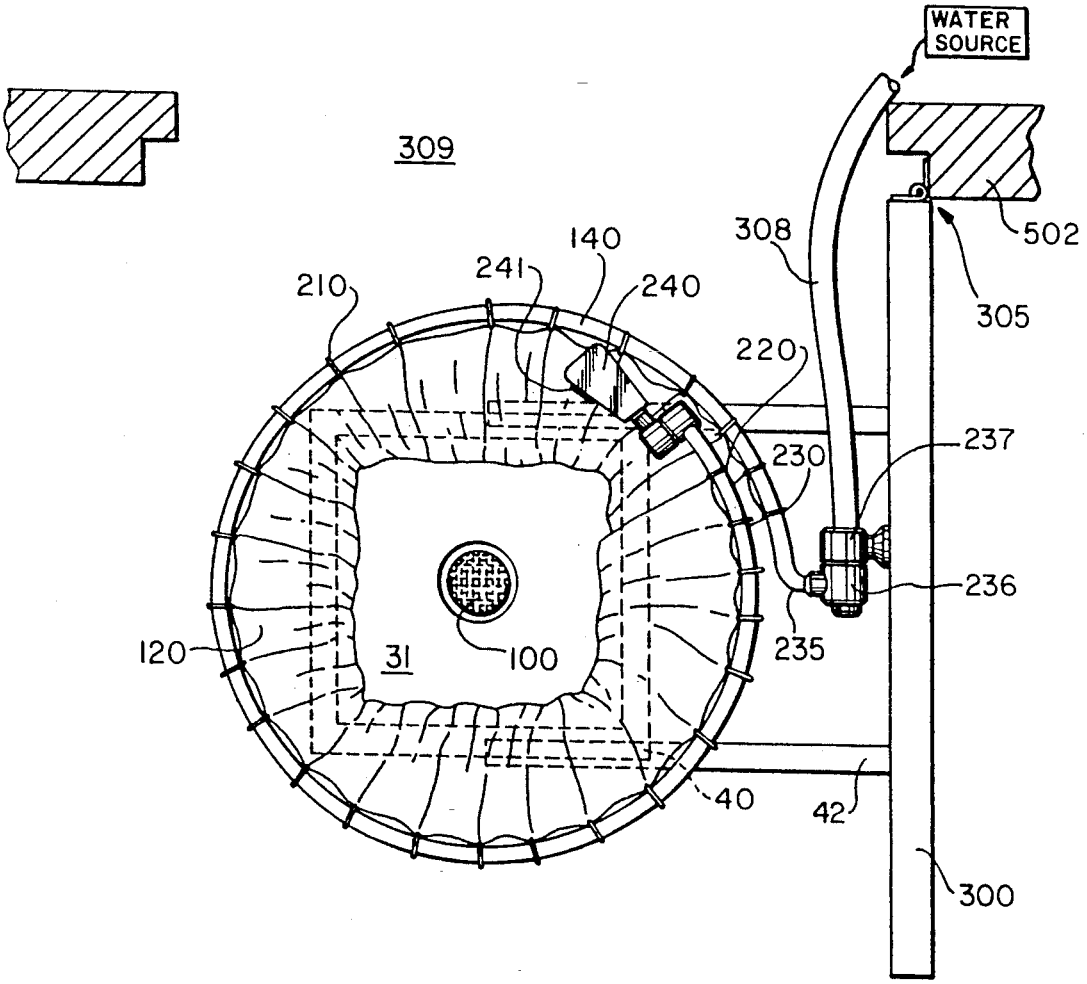
FIG. 11 is a top plan view of the apparatus as shown in FIG. 10.

In the embodiments shown in the Figures, the support rod 140 has a spiral configuration as best shown in FIGS. 4, 11. Such a configuration enables the user to slidably expand the top end 150, FIG. 3, of the curtain 120, FIGS. 1–4, 5 on the rod 140, FIGS. 1–4, to the point where the right side edge 220, FIG. 4, overlaps the left side edge 230, FIG. 4, of the curtain 120, FIGS. 1–4, thus forming a completely enclosed water-containment space 170 such that water 250, FIG. 3, which is directed into the space 170 cannot escape between the two side edges 220, 230, FIG. 4, of the curtain 120.

As best shown in FIG. 4, the outer terminal end 235 of the spiral tube 140 is connected to a conventional pivotable hinge element 236 which is rotatably pivotable around axis X on hinge element 237. As shown in FIGS. 1–6, the hinge element 236 is lockable in a position whereby the support rod 140 is extended into a horizontal position so that the curtain can be expanded to form the upper part of the shower enclosure. The hinge elements 236, 237, FIG. 4, include a conventional lock mechanism which can be unlocked to enable the hinge element 236, FIG. 4, and rod 140, FIGS. 1–4, to be pivoted or retracted downwardly (as shown, for example, in FIG. 8) to a space-compact position relatively flat against the wall 180, FIGS. 1–4.

Figure 5:
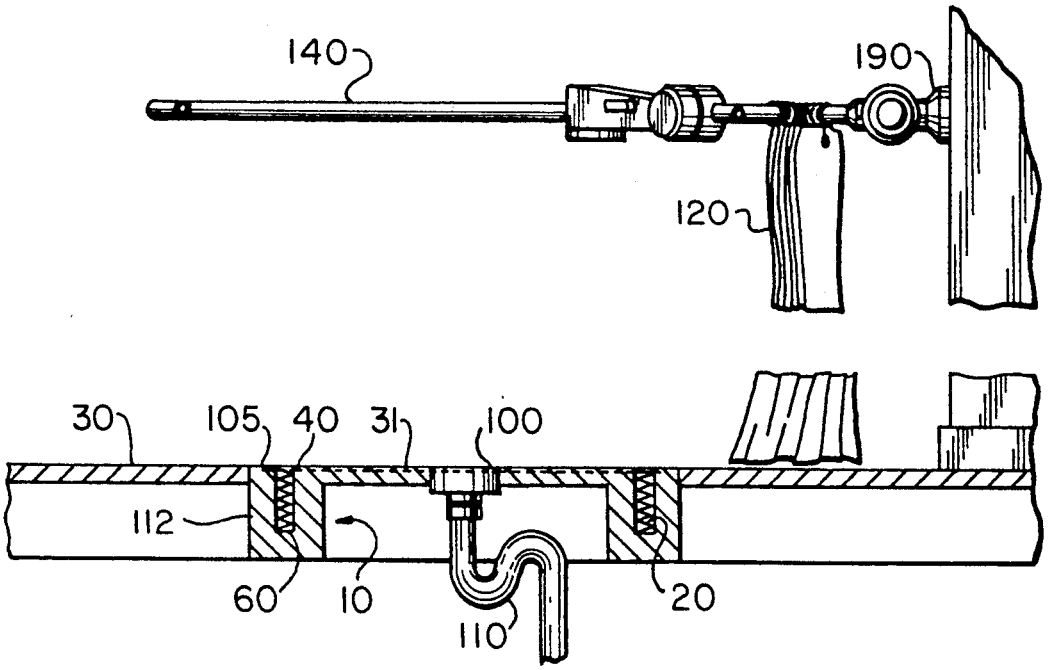
FIG. 5 is a side cut-away view of the apparatus as shown in FIG. 1; and, FIG. 6 is a side cut-away view of the apparatus as shown in FIG. 3.

As shown in FIGS. 5, 6 the bottom end 60 of the water-impervious wall material 50 of the base unit 10 is water sealably attached to the bottom of the recess 20 in the floor 30. The recess 20 surrounds the floor area 31 in which the water drain 100 is disposed and on which the user stands. In one method of use, a user might first step onto the floor area 31 and then manually lift the top end 40 of the base unit 10 upwardly into the stable shower-ready position shown in FIGS. 2, 3.

Alternatively, a user may first manually pull the unit 10 into the stable upright position shown in FIGS. 2, 3 and then subsequently step into the water-containment space 70, FIG. 2. the maximum height H, FIG. 1, of the upright position from the floor being selected in such an embodiment to be, only so high, for example 0.5 to 3.0 feet, as to enable a user to conveniently step over the top end 40 into the space 70, FIG. 2, and onto the floor area 31 surrounded by recess 20, FIGS. 5, 6.

Although, as described below, base unit 10 is typically used in conjunction with an expandable upper unit, the collapsible enclosure 10 may be used alone to provide a collapsible shower stall according to the invention. When the base unit 10 is used by itself, the minimum upright height H is selected to be at least about as high as the height of the intended user such that the top end 40 reaches upwards to or above at least the height of the intended user, for example to at least about four to seven feet high from the floor.

As shown in FIGS. 1, 5 when the base unit 10 is in its completely collapsed state, it fits compactly into the recess 20 provided within the floor 30. Also in the collapsed state, the top end 40 lies flush or substantially flush with the top surface of the floor 30 as shown in FIGS. 1, 5. The top end 40 typically comprises a rigid rim or border to which the sheet material 50 is sealably attached, the outer circumference of the rim 40 seating within a flange or flange-like recess portion 105 of recess 20, FIGS. 5, 6, when the base unit 10 is completely collapsed. When the rim 40 is seated within recess portion 105, FIGS. 5, 6, the top surface of the rim 40 is flush with the top surface of the floor 30 forming a continuous flat surface with the surface of the floor 30 such that the enclosure 10 does not interrupt the continuity of the surface of the floor at least insofar as a person walking on the floor is concerned.

The base unit 10 includes a mechanism for maintaining the unit 10 in the stable upright position shown in FIGS. 2, 3, 4, 6 such as a spring, a spring-loaded mechanism or other conventional mechanism for holding the top end 40 of the base unit 10 in the upright position such as a pivoting lever mechanism connected between the top end 40 and the floor 30 or recess 20, FIGS. 5, 6, which can reversibly lock the upper end 40 in place at the selected minimum height H. In the embodiment shown in the Figures, the material 50 is formed into a bellows configuration and is provided with a resiliently compressible spring 52, FIGS. 2, 3, attached to the material 50 and extending between the top 40 and bottom 60 ends, FIGS. 5, 6, of the base unit 10. The spring mechanism may be constructed so as to constantly urge the base unit 10 upwards and is resiliently compressible together with the sheet material 50 and top end 40 into the recess 20, FIGS. 5, 6. Once collapsed into the recess 20, FIGS. 5, 6 the spring-loaded base unit 10 can be maintained in its collapsed position within recess 20, FIGS. 5, 6, by conventional means such as a simple latch mechanism (not shown) or snap fit of the rim 40 within recess portion 105, FIGS. 5, 6. One or more small apertures (not shown) may be provided in the rim 40 for enabling the user to manually pull the enclosure upwards and disengage the top end rim 40 from its latched or snap fit position within the recess 20, FIGS. 5, 6. Once released from its latched or snap-fit position, the unit 10 can then assume its upright position under the upward urging force of the spring load. One embodiment for such a spring mechanism may comprise a spiral spring extending around the material 50 between the top 40 and bottom 60, FIGS. 5, 6, ends in the nature of a jack-in-the-box arrangement.

As shown, a water drain 100, FIGS. 1, 5, 6, is disposed within the floor area 31 surrounded by the recess 20 and enclosure 10. The drain receptacle 100, FIGS. 1, 5, 6, is preferably mounted such that it is flush with the top surface of the surrounded floor area 31 whereby a continuous evenly-surfaced floor is maintained. The drain receptacle 100 is sealably connected to a conventional drain run-off pipe 110, FIGS. 5, 6.

The bottom end 60, FIGS. 5, 6, of the enclosure 10 is sealably connected to a surface within the recess 20, FIGS. 5, 6, such that when the enclosure 10 is in its upright position a water-sealed border is formed around the drain receptacle 100, FIGS. 1, 5, 6, whereby any water which is dispensed into the space 70, FIG. 2, falls by gravity onto the floor area 31 and cannot escape outside space 70 except through drain receptacle 100. The floor area 31 may be slightly pitched, e.g. in a downwardly concave manner, toward drain receptacle 100, FIGS. 1,5, such that any residual water on the surface of floor area 31 is ultimately routed by the slight pitch toward receptacle 100.

In a practical commercial product embodiment, the base unit 10 may include a mounting base unit 112, FIGS. 5, 6, having the flexible wall 50 and associated spring mechanism ready-mounted in the recess 20 such that the associated components can be readily installed as a unitary package in the floor 30, FIGS. 5, 6, of an existing room.

Figure 7:
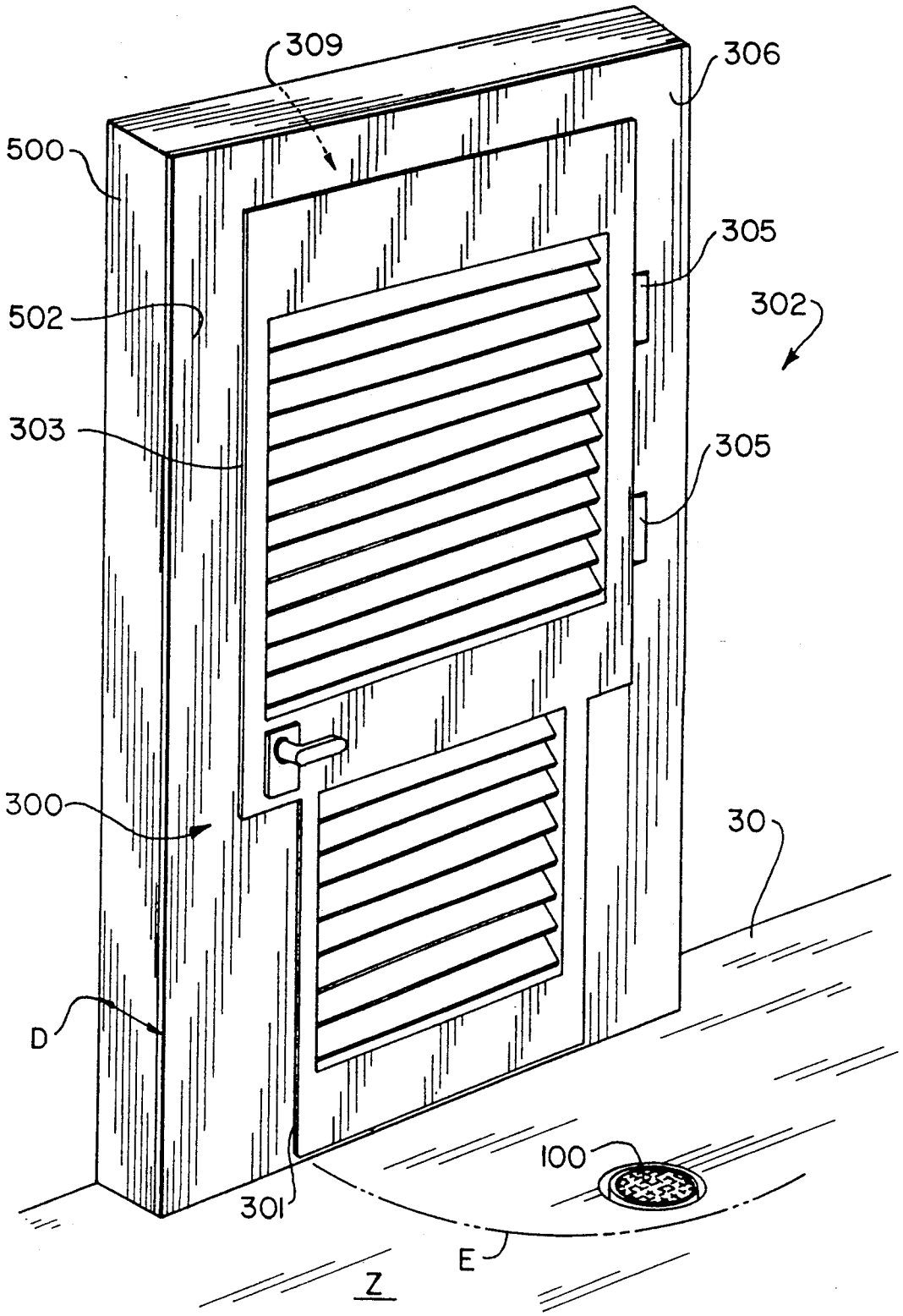
FIG. 7 is a perspective view of another exemplary embodiment of the invention showing the outside surface of a closed door mounted in a room having a drain in the floor, the collapsible shower enclosure components being mounted on the inside surface of the door.

With reference to FIG. 7, an apparatus according to the invention may include or be mounted on a door 300. As shown in FIG. 7, the door 300 is closed such as to be substantially flush with a frame 502 within a cabinet 500 housing the apparatus. The cabinet 500 typically has a shallow depth D of between 3 and 12 inches, FIG. 7.

Alternatively, the door 300 and frame 502 are flush with a wall 302 of the room, and the apparatus is within the hollow 309 of this wall 302.

Figure 8:
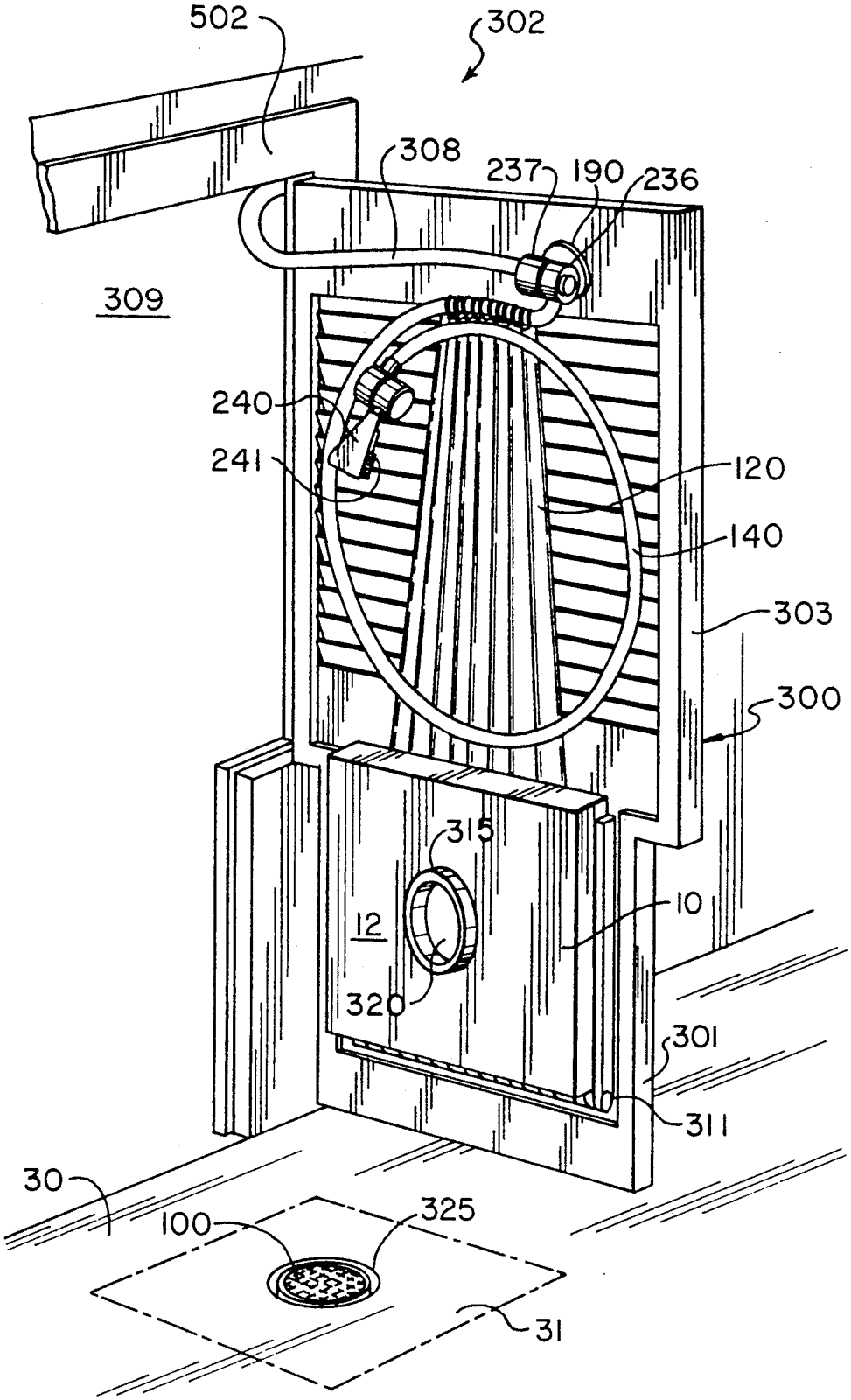
FIG. 8 is a serial perspective view of the FIG. 7 embodiment showing the door in an open position and collapsible base and upper unit components mounted on the inside surface of the door in retracted space compact positions.

The door 300 is mounted on hinges 305 so that it may be swung open as shown in FIG. 8. On the inside surface of door 300 is mounted the base unit 10 and the upper expandable unit comprising the spiral support tube 140 and curtain 120. The mounting bracket 190 is attached to the inside surface of the door 300 and the hollow spiral tube 140 is connected to flexible piping or tubing 308 which is in turn connected to conventional water-feed piping (not shown) inside the closet space 309 enclosed by the door 300 when closed. As shown in FIG. 8, the spiral support tube 140 is pivoted downwardly on hinge elements 236, 237 in a space-compact position against the inside surface of the door 300. The base unit 10 is similarly mounted on the inside surface of door 300 via conventional position-lockable hinges 311. As shown in FIG. 8 the base unit 10 is pivoted upwardly in a collapsed space-compact position against the inside surface of door 300. As shown in FIG. 8, when the upper unit and lower base unit are in their pivotably retracted and collapsed positions, the door 300 may be closed as shown in FIG. 7 and the upper and lower expandable units compactly stored in a relatively small closet space 309 provided within the wall 302 or within the cabinet 500.

Figure 9:
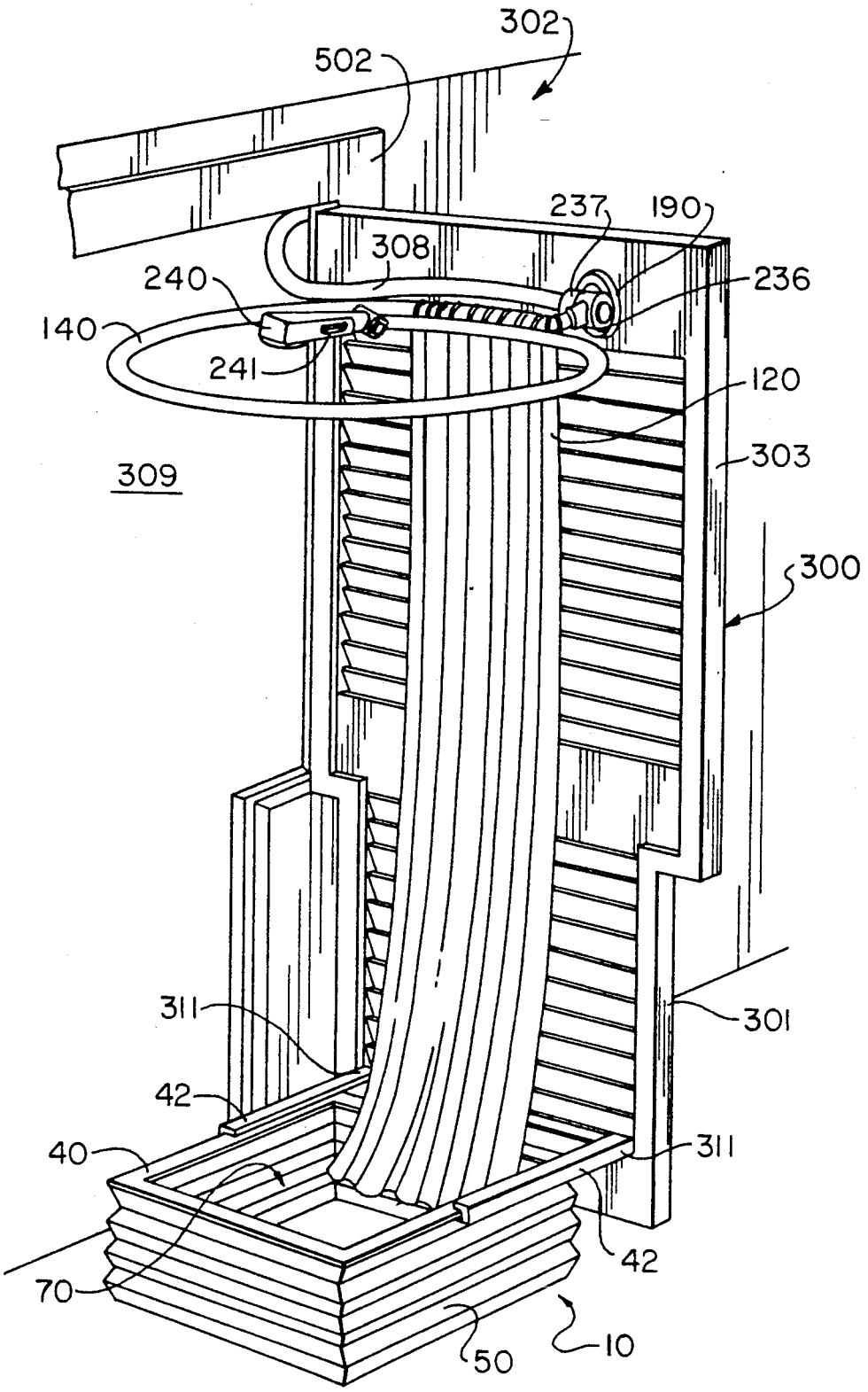
FIG. 9 is a serial perspective view of the FIGS. 7, 8 embodiment showing the base unit extended and expanded into a shower-ready water containment enclosure position and showing the upper unit in an extended position.

As shown in FIGS. 8, 9 the door is mounted on the wall such that when it is swung open, the base unit 10 may be pivoted downwardly into a shower-ready position extending outwardly from the inside surface of the door 300 and then expanded, FIG. 9. A rim 315, FIG. 8, surrounding an aperture 320 is provided in a bottom surface of the base unit 10, such that when the base unit 10 is extended and expanded into the position shown in FIG. 9, the rim 315 is aligned with a complementary receiving aperture 325, FIG. 8, provided around the edge of the drain receptacle 100 within the floor area 31.

As shown in FIG. 9, the top end 40 of the base unit 10 is pivoted downwardly on hinges 311 and locked by conventional means in the extended or outwardly pivoted, shower-ready position as shown in FIG. 9. The flexible wall 50 is expanded and the rim 315 protruding from the bottom surface 12 of the unit 10 is aligned with and then seated within the rim receiving aperture 325. Further details of the rim 315 seating within floor aperture 325 are described below with reference to FIGS. 15, 16. As shown in the FIG. 9 embodiment, the top end 40 of the base unit 10 is slidably mounted in rails 42 for slidably adjustable movement inwardly and outwardly from the door 300 such that rim 315 may be readily aligned with the floor aperture 325.

Figure 10:
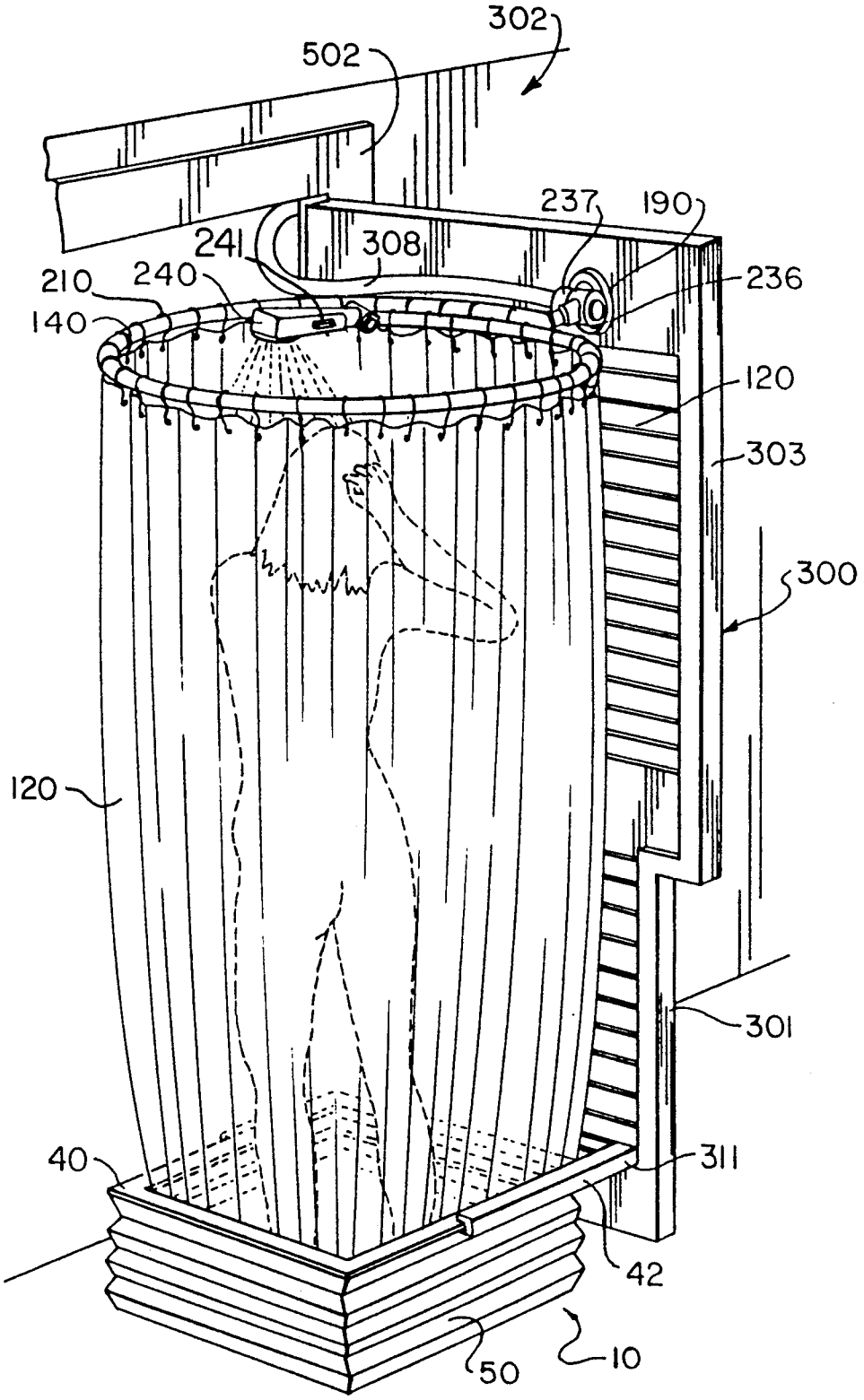
FIG. 10 is a serial perspective view of the FIGS. 7, 8, 9 embodiment showing both the base and upper units extended and expanded into a two-component shower-ready water containment enclosure with a human taking a shower within it.

With the base unit 10 in its expanded position shown in FIG. 9, a user may then pivot support tube 140 upwardly into an outwardly-extended position, and then step into space 70 and expand the curtain 120 around the length of spiral support tube 140 to form the shower-ready enclosure depicted in FIGS. 10, 11.

As shown in the top plan view of FIG. 11, the door 300 is swingably mounted by a conventional hinge 305 mechanism pivotably connecting the door 300 to the frame 306 which may be mounted in or against the wall 302, FIG. 7, of the room such that the door 300 occupies as little space in the room as possible when closed. Note that the lower segment 301 of the door is narrower than the upper segment 303 so that it will not collide with a toilet or sink in its excursion E.

Figure 12:
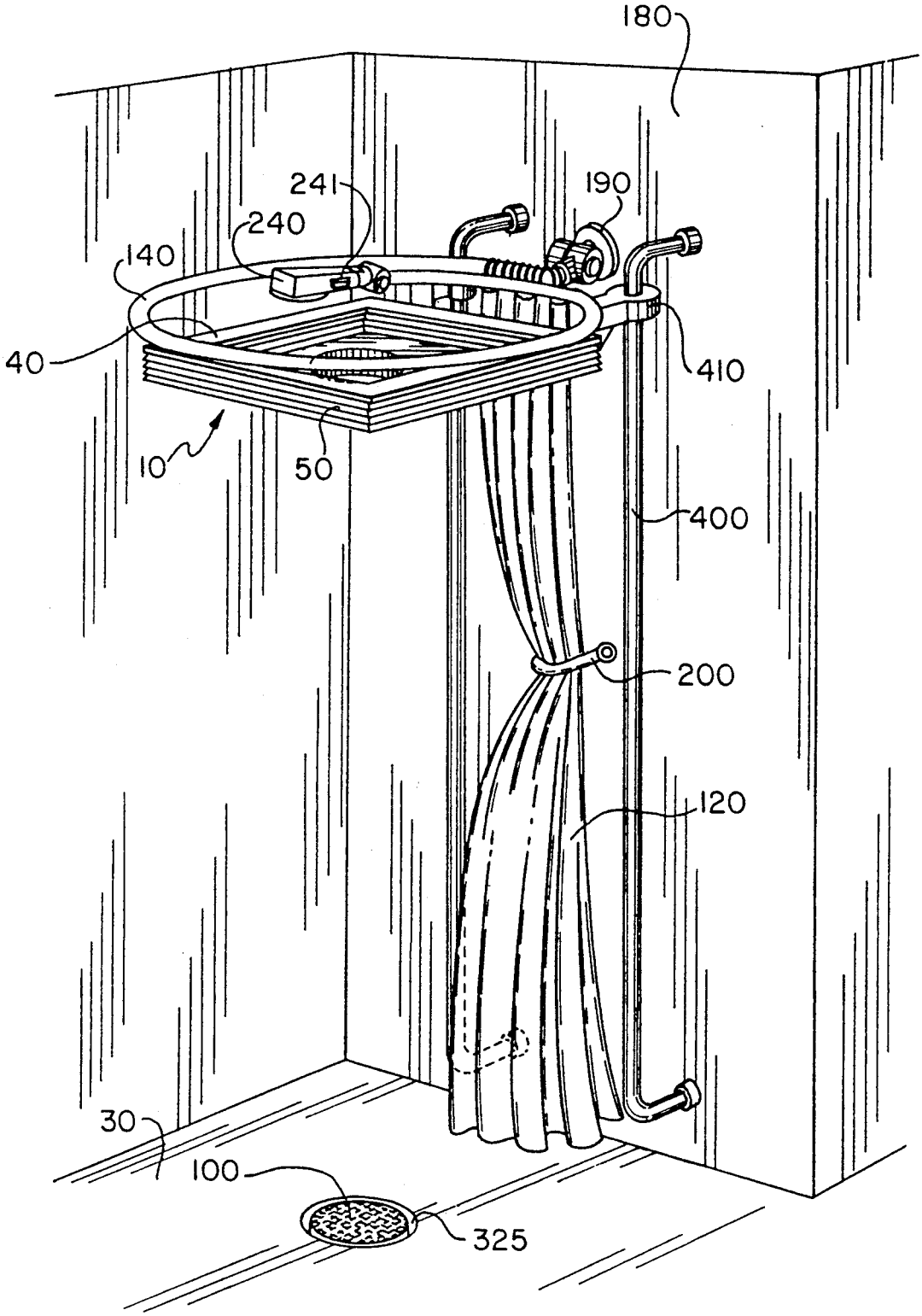
FIG. 12 is a perspective view of a third exemplary embodiment of the invention showing the collapsible base (in its high stored position) and upper unit components in their collapsed, space-compact, retracted positions.
Figure 13:
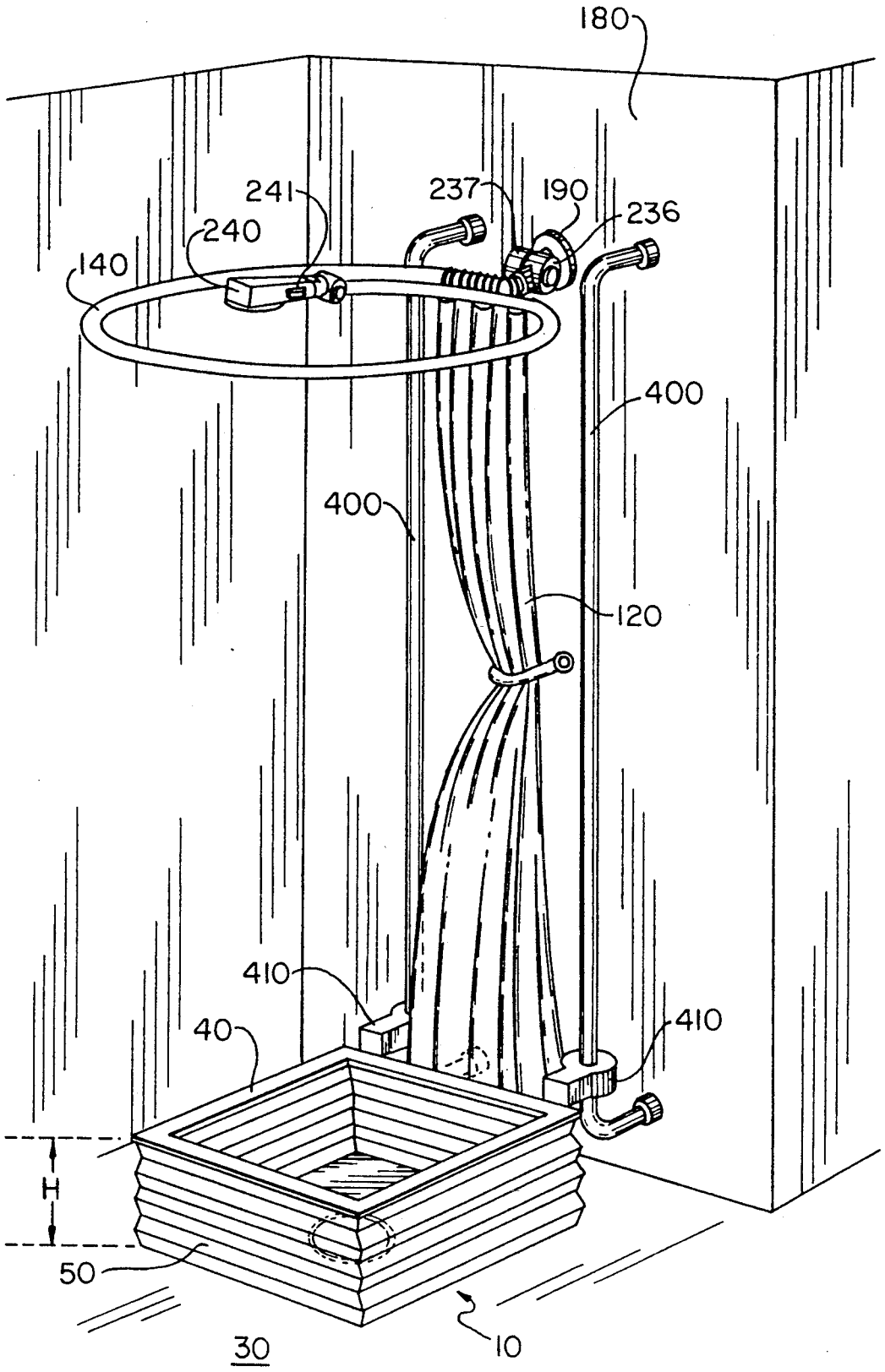
FIG. 13 is a serial perspective view of the FIG. 12 embodiment showing the base unit in a lowered shower-ready, expanded enclosure position.
Figure 14:
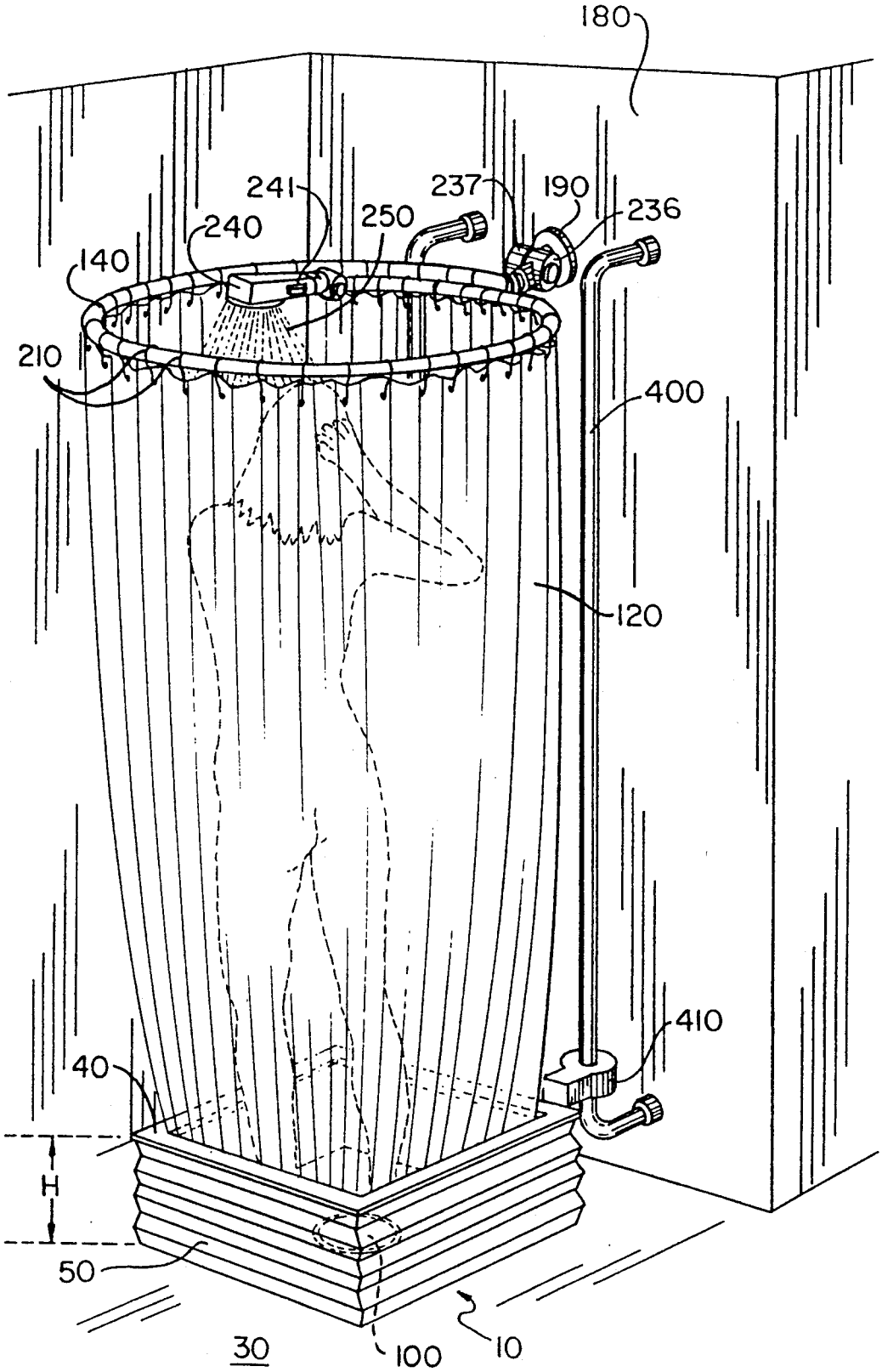
FIG. 14 is a serial perspective view of the FIGS. 12, 13 embodiment showing both the upper and lower units in their expanded, shower-ready, water-containment enclosure positions.

With reference to FIGS. 12–14, in another embodiment of the invention, the base unit 10 is slidably mounted on vertical support rods 400 which are attached to the wall 180. As shown in FIGS. 12–14, the top end rim 40 of the base unit 10 is connected to support arms 410 which have apertures which slidably encircle and receive rods 400. Alternatively, both the support arms and the spiral rod can have hinge joints (see below) 236, FIG. 11, which allow the base unit and spiral rod, respectively, to be folded against the wall in storage position.

Alternatively, the support rods 400, FIG. 12 can have a telescoping configuration (not shown), allowing the support rods to have a compact-storage position at the level of the storage position of the base unit. If this is done, the curtain 120, FIG. 12 can be folded on itself from midpoint so that its storage position can be similar to that of the other elements of the apparatus. Support arms 410 are provided with a conventional latch mechanism such as lock screws, clamps or pins which are engageable against the outside surface of rods 400 or insertable into complementary apertures provided along the length of rods 400 such that the arms 410 can be fixed or locked at any desired height along the length of beams 400.

As shown in FIG. 12 in the collapsed, space-compact position of the apparatus, the base unit 10 is initially locked in an upper position closely adjacent to support tube 140 with the curtain 120 and bellows 50 collapsed.

The bottom end of the base unit 10 is provided with a seating rim such as the seating rim 315 described with reference to FIG. 8 and a complementary aperture 325 is provided within the floor 30 around drain 100 for receiving the seating rim on the bottom of the base unit 10.

As shown in FIG. 13, the arms 410 have been unlocked from their position on the beams 400 shown in FIG. 12 and slid to a lower position and locked such that the top end 40 of the base unit 10 is fixed at the desired predetermined height H above the floor 30. The bellows 50 is expanded, FIG. 13, and the seating rim on the bottom of the base unit is seated within the receiving aperture 325 surrounding the drain 100.

As described above, the curtain 120 is then unstrapped, slidably expanded around the spiral support tube 140 and the bottom end of the curtain, extending to below the height H of the top 40 of the base 10, is inserted within the top 40 of the base 10 forming a single continuous water enclosure as shown in FIG. 14. The spiral support tube 140 is connected to a water input and a water-dispensing outlet 240 as described above with reference to other embodiments. It is to be noted that the upper and lower units of this embodiment, in their folded storage position, can be concealed by a curtain, panel, or cabinet.

Figure 15:
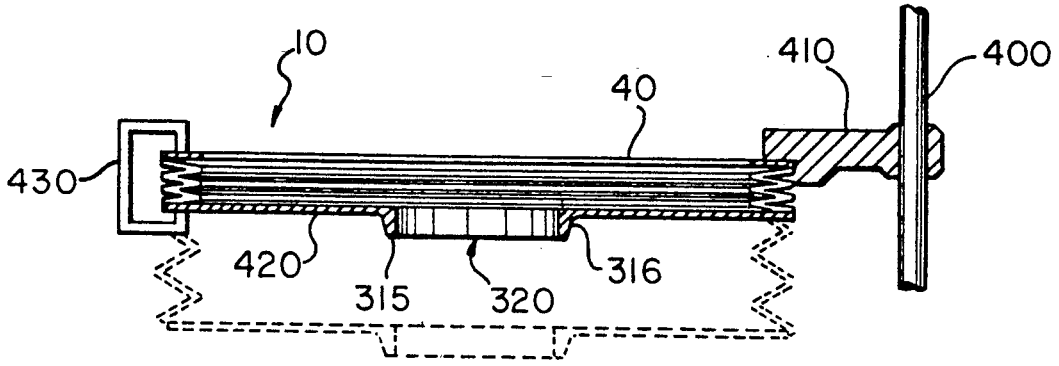
FIG. 15 is a side cross-sectional view of the base unit of the FIGS. 12–14 embodiment.
Figure 16:
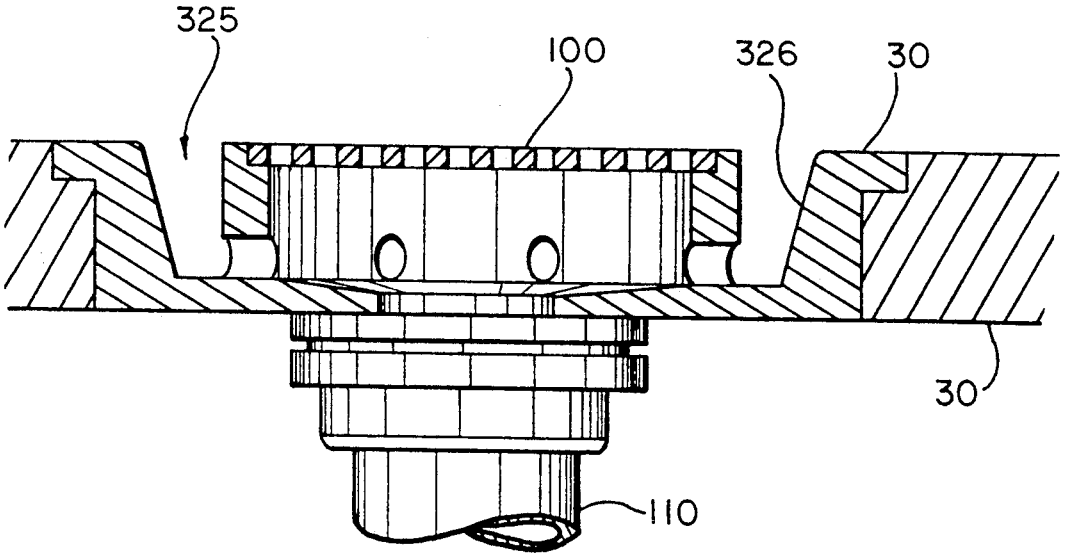
FIG. 16 is a side cross-sectional view of a drain mounted in a floor of a room adapted to work in conjunction with the base unit of the FIGS. 7–14 embodiments.

FIGS. 15, 16 depict a typical detail of the rim 315 and receiving aperture 325 elements described above for use with the FIGS. 7–14 embodiments of the base unit 10. As shown in cross-section in FIG. 15, the bottom end 420 of the base unit 10 is provided with a rim 315 which defines a water outlet aperture 320 in the bottom end 420 of the base unit 10. The outer circumference of the rim 315 has a bevelled surface 316 which mates against a complementary outer circumferential surface 326 provided in receiving aperture 325, FIG. 16. As shown in FIG. 16 the receiving aperture 325 surrounds drain 100 and is complementary in configuration to the configuration of the rim 315 such that, when inserted into the aperture 325, the rim 315 can be snugly inserted and thus prevent shower water 250, FIG. 14, from leaking onto the floor area 30, FIG. 14.

As depicted in the Figures, the base unit 10 has a square configuration in cross-section. The base unit 10 can have any desired cross-sectional configuration such as circular, pentagonal, hexagonal and the like.

In the FIGS. 7–14 embodiments, the collapsible water-impervious material 50 of the base unit may be held in the collapsed positions shown in FIGS. 8, 12 and 15 by any conventional clasping mechanism such as a clasp or clip 430, FIG. 15, which holds the top 40 and bottom 420 ends of the unit 10 together. In the base unit 10 embodiment shown in FIGS. 8, 12, a spring mechanism for urging the top 40 and bottom ends of the unit 10 apart may not be necessary insofar as the weight of the material 50 may allow the bottom end of the unit to naturally fall into an expanded position when the top 40 and bottom ends are unclipped from each other.

In a further embodiment of the invention, the base and upper units of the apparatus may be detachable or removable from their mounted positions as shown in the embodiments in all of the Figures and stored as independent units in a convenient storage place. In such an embodiment, the base unit could, for example, be collapsed, stored in a collapsed state in a storage place, transported from storage, expanded into an enclosure position similar to that shown in FIGS. 2, 3, 6, 9, 10, 13, 14 and manually mounted on the floor area surrounding the drain 100 in the floor as an independent, free-standing unit. Preferably in such an embodiment, the bottom of the base unit would be provided with a mechanism for providing a water seal around the drain in the floor such as described above with reference to the embodiments of FIGS. 7–14 where rim 315, FIGS. 8, 15, seats within a complementary slot or aperture 325 surrounding the drain receptacle 100 in the floor 30, FIGS. 15, 16.

As can be readily imagined, the upper spiral support 140 shown in all of the Figures may be constructed so as to be readily detachable by conventional means from hinge element 236, FIGS. 4, 8, 9, 11, 13, 14 and reattachable such that a secure water-sealed connection can be readily effected when desired. When detached, the spiral support tube 140 is easily storable as an independent unit in a storage place with its associated expandable curtain 120 folded up. Alternatively, the end of the upper support rod 140 shown in the Figures could be configured so as to be plugged into a suitable water-feed supply pipe which is recessed within the wall 180 of the room, the plug connection being readily attachable and detachable by hand, and the water supply activated by an independent valve with control.

Figure 17:
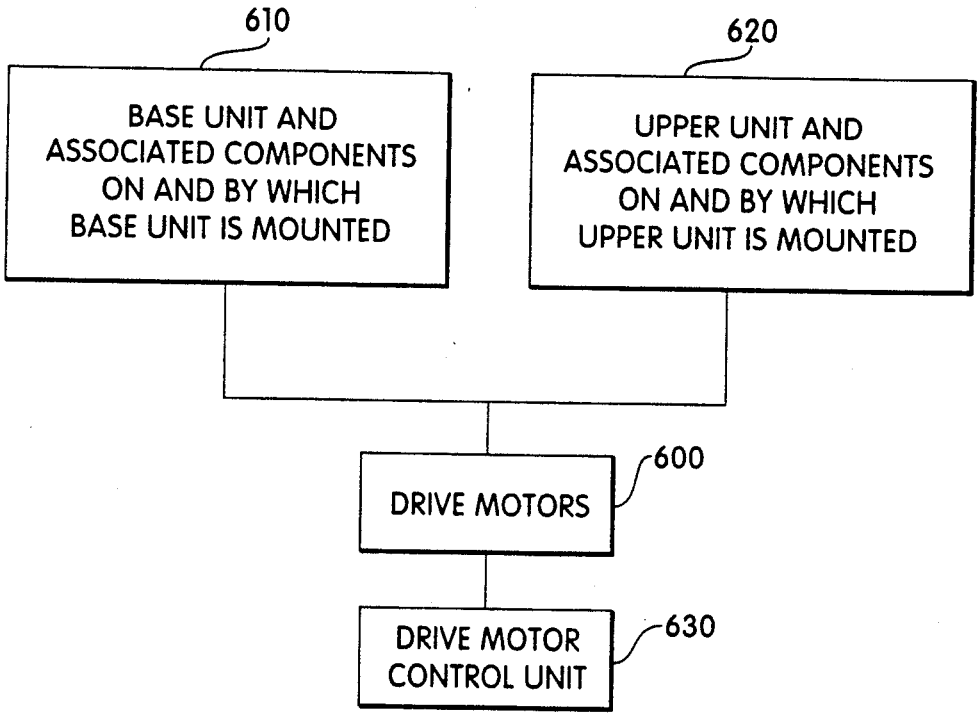
FIG. 17 is a schematic view of a programmably controlled motor drive assembly for automatic operation of an apparatus according to the invention.

In the various embodiments described with reference to all of the Figures above, the apparatus may be provided with conventional means for automatically expanding/collapsing and extending/retracting the upper and lower units. For example, electric or pneumatic motors 600, FIG. 17, may be connected by conventional means to various components of the base and upper units 610, 620, FIG. 17, such that the motors 600, FIG. 17, may be operated to automatically expand/collapse and extend/retract the base and upper units into and out of their fully expanded, shower-ready, water-enclosure positions. Such motors 600, FIG. 17, may be connected to conventional programmable control means 630, FIG. 17, such as a preprogrammed microprocessor, computer or the like which controls movement of the various components of the base and upper units 610, 620, FIG. 17, in a predetermined sequence. By way of example, with reference to the FIGS. 7–11 embodiments, upon activation of a suitable switch connected to the control unit 630, FIG. 17, door 300 may be automatically opened from its closed position, FIG. 7, into the open position shown in FIG. 8. Subsequently, in a predetermined sequence determined by the program 630, FIG. 17, which controls the drive of the motors 600, FIG. 17, the rails 42 may be drivably pivoted around hinges 311 from their retracted position, FIG. 8, into their extended position, FIG. 9, and the bellows 10 may be simultaneously extended outwardly along rails 42 and expanded into its enclosure form, FIG. 9; and as a result of the automatic expansion and extension of the base unit 10, the seating rim 315, FIG. 8, may be automatically seated within the aperture 325, FIGS. 8,16, surrounding the drain receptacle 100. Similarly, the upper support tube 140 may be drivably extended, simultaneously or in some other predetermined sequence determined by the control unit, 630, FIG. 17, from its retracted position, FIG. 8, into its extended position, FIG. 9, by controllably driven pivoting of hinge element 236, FIGS. 8, 9. The curtain 120 may also be drivably connected to the programmably controlled motor drive 600, FIG. 17, such that the curtain 120, FIGS. 8, 9, automatically expands from its collapsed position, FIG. 9, into its fully expanded position, FIGS. 10, 11, around the length of spiral support tube 140. As can be readily imagined, the reverse sequence of steps can be automatically effected by the control unit 630 and motor drive mechanisms 600, FIG. 17, whereby the apparatus automatically retracts and collapses back into its fully closed, space-compact state.

As can be readily imagined, those components of the embodiments described with reference to FIGS. 1–6 and FIGS. 12–14 which are analogous to those in the FIGS. 7–11 embodiment can be automated in a manner similar to that described above with reference to the FIGS. 7–11 embodiment to effect automatic expansion/collapse and extension/retraction of the base and upper units. With respect to the base unit 10 described with reference to all of the Figures, the wall 50 of the bellows 10 may comprise an inflatable balloon or bag mechanism (in the nature of an inflatable swimming pool) connected to a pump which is controllably driven by the control unit 630, FIG. 17, to inflate (expand) and deflate (collapse) the bellows in a predetermined sequence to effect automatic expansion/collapse of the base unit 10. With reference to the FIGS. 12–14 embodiment, the base unit 10 can be automatically lowered from its upper position, FIG. 12, to its lower position, FIG. 13, by connecting arms 410, FIGS. 12–14, to the motor drive 600, FIG. 17, and driving arms 410 along the length of support rods 400, FIGS. 12, 13 as prescribed by the control unit 630, FIG. 17.

In any embodiment where expansion/collapse or extension/retraction of the base and upper units may be automatically driven, suitable sensor mechanisms are preferably provided for detecting the presence or absence of any object which may occupy the spaces into or through which the various components are extended or expanded. Such sensor mechanisms are provided for sending a safety signal to the programmed drive control mechanism which prevents the drive control from operating when an object is detected as being present within any space into or through which the base or upper units may expand or extend.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A collapsible shower apparatus adapted to be mounted in a room having a water drain in a floor, the apparatus comprising:

a unitary bellows base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure, said upper unit further comprising a spiral rod and a water-impervious curtain slidably hung on the rod, the curtain having two terminal longitudinal ends and the rod being spirally configured such that the two ends of the curtain are slidable past each other.

2. The apparatus of claim 1 wherein the upper unit when expanded has a bottom end contained within a top end of the lower unit when expanded.

3. The apparatus of claim 1 wherein the base unit when expanded has a bottom end which water-sealably surrounds the drain in the floor.

4. The apparatus of claim 1 wherein the base unit comprises a reversibly expandable and retractable bellows.

5. The apparatus of claim 1, the base unit having an open top end mounted at the predetermined height above the floor when the base unit is expanded, the spiral rod being mounted above the predetermined height of the top end of the base unit, the curtain having a length sufficient such that a bottom end of the curtain extends downwardly from the support rod to below the predetermined height of the top end of the base unit when the units are expanded.

6. The apparatus of claim 5 wherein the bottom end of the curtain is insertable within the open top end of the base unit when the units are expanded, the expanded units forming a single continuous water-containment enclosure when the bottom end of the curtain is inserted within the open top end of the base unit.

7. The apparatus of claim 5 wherein the base unit is adapted to be mounted in the room on a vertically-disposed support rod means, the base unit being adjustably mountable on the support rod means at any selected height above the floor along the length of the support rod means.

8. The apparatus of claim 5 wherein the base unit is adapted to be mounted in the room such that the base unit is collapsible into the floor around the drain.

9. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure; wherein the upper unit comprises a spiral rod and a water-impervious curtain slidably hung on the rod; and wherein the spiral rod comprises a spiral hollow tube adapted to be connected to a source of water input and an outlet for dispensing water which is input into the tube.

10. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure; wherein the upper unit comprises a support rod and a flexible water-impervious curtain slidably hung on the rod, the base unit having an open top end mounted at the predetermined height above the floor when the base unit is expanded, the support rod being mounted above the predetermined height of the top end of the base unit, the curtain having a length sufficient such that a bottom end of the curtain extends downwardly from the support rod to below the predetermined height of the top end of the base unit when the units are expanded;

wherein the bottom end of the curtain is insertable within the open top end of the base unit when the units are expanded, the expanded units forming a single continuous water-containment enclosure when the bottom end of the curtain is inserted within the open top end of the base unit;

wherein the upper unit comprises a spiral rod and a water-impervious curtain slidably hung on the rod; and, wherein the spiral rod comprises a hollow tube adapted to be connected to a source of water input and connected to an outlet for dispensing water which is input into the tube.

11. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure;

wherein the upper unit comprises a support rod and a flexible water-impervious curtain slidably hung on the rod, the base unit having an open top end mounted at the predetermined height above the floor when the base unit is expanded, the support rod being mounted above the predetermined height of the top end of the base unit, the curtain having a length sufficient such that a bottom end of the curtain extends downwardly from the support rod to below the predetermined height of the top end of the base unit when the units are expanded; and, wherein the base unit and the upper unit are mounted on a door within a frame mounted on a wall of the room, the door being swingable between open and space-compact closed positions, the upper and lower units being pivotably mounted on an inside surface of the door for movement between a space-compact, retracted position for enabling the door to be closed and an extended position when the door is opened wherein the units are expandable into the first and second water-containment enclosures.

12. The apparatus of claim 11 wherein the upper and base units are adapted in their space-compact positions to fit into a hollow in the wall.

13. The apparatus of claim 11 wherein the frame of the door is part of a cabinet, which is mounted on the wall of the room.

14. The apparatus of claim 11 wherein the door is mounted on a housing, the housing being mountable within the room, the base and upper units being storable within the housing when the base and upper units are in their collapsed and retracted positions and when the door is closed.

15. The apparatus of claim 14 wherein the housing comprises a box having a depth of between 3 and 12 inches.

16. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure;

wherein the upper unit comprises a support rod and a flexible water-impervious curtain slidably hung on the rod, the base unit having an open top end mounted at the predetermined height above the floor when the base unit is expanded, the support rod being mounted above the predetermined height of the top end of the base unit, the curtain having a length sufficient such that a bottom end of the curtain extends downwardly from the support rod to below the predetermined height of the top end of the base unit when the units are expanded; and, wherein the base unit has a bottom end having a mechanism for water sealably surrounding the drain in the floor when the base unit is expanded into a water-containment enclosure, the water-sealing mechanism on the base unit being receivable in an aperture surrounding the drain in the floor.

17. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure;

wherein the upper unit comprises a support rod and a flexible water-impervious curtain slidably hung on the rod, the base unit having an open top end mounted at the predetermined height above the floor when the base unit is expanded, the support rod being mounted above the predetermined height of the top end of the base unit, the curtain having a length sufficient such that a bottom end of the curtain extends downwardly from the support rod to below the predetermined height of the top end of the base unit when the units are expanded; and, wherein the apparatus further comprises means for automatically expanding the base and upper units from their collapsed state into their expanded enclosure positions.

18. The apparatus of claim 17 wherein the automatic expanding means further comprises means for automatically collapsing the base and upper units from their expanded enclosure positions into their collapsed states.

19. The apparatus of claim 18 wherein the automatic expanding means comprises a motor mechanism connected to a program for controlling the drive of the motor mechanism.

20. A collapsible shower apparatus adapted to be mounted in a room having a water drain in a floor, the apparatus comprising:

a base unit collapsible into a space-compact position and expandable into a first water-containment enclosure surrounding the drain in the floor and extending from the floor upwardly to a predetermined height above the floor; and an upper unit mounted above the base unit, the upper unit being collapsible into a space-compact position and expandable into a second water-containment enclosure mounted directly above the first enclosure;

wherein the upper unit comprises a rod and a water-impervious curtain slidably hung on the rod, the curtain having two terminal longitudinal ends and the rod being spirally configured such that the two ends of the curtain are slidable past each other.

21. The apparatus of claim 20 wherein the base unit has an expandable wall comprising a flexible water-impervious material.

22. The apparatus of claims 10, 11, 16, 17, or 20 wherein the base unit comprises a reversibly expandable and retractable bellows.

* * * * *